United States Patent [19]

Skatsche et al.

[11] 4,383,502

[45] May 17, 1983

[54] WATER-COOLED INTERNAL COMBUSTION ENGINE USING HYDRAULIC-OIL LUBRICATION AND COOLING-WATER PUMP

[75] Inventors: Othmar Skatsche; Bertram Obermayer, both of Graz, Austria

[73] Assignee: Hans List, Graz, Austria

[21] Appl. No.: 228,220

[22] Filed: Jan. 26, 1981

[30] Foreign Application Priority Data

Jan. 24, 1980 [AT] Austria ..... 391/80

[51] Int. Cl.[3] ..... F01P 5/12

[52] U.S. Cl. ..... 123/41.44; 123/196 S

[58] Field of Search ..... 123/41.01, 41.44, 41.46, 123/41.49, 198 C, DIG. 5, 41.12, 196 R, 196 S

[56] References Cited

U.S. PATENT DOCUMENTS

| | | | |
|---|---|---|---|
| 3,659,567 | 5/1972 | Murray | 123/41.49 X |
| 3,710,765 | 1/1973 | Dorsch | 123/41.12 |
| 3,911,877 | 10/1975 | Sigoit et al. | 123/41.46 X |
| 4,062,329 | 12/1977 | Rio | 123/41.49 X |
| 4,066,047 | 1/1978 | Yidakovic et al. | 123/41.49 X |
| 4,223,646 | 9/1980 | Kinder | 123/41.49 X |

*Primary Examiner*—William A. Cuchlinski, Jr.
*Attorney, Agent, or Firm*—Watson, Cole, Grindle & Watson

[57] ABSTRACT

A water-cooled internal combustion engine includes piping defining a hydraulic oil circuit having an oil pump and using hydraulic oil lubrication and a cooling-water pump driven as a function of the operating condition of the engine. The hydraulic motor is provided in the circuit for the drive of the cooling-water pump which, by means of a control element, can be switched into the hydraulic oil circuit of the internal combustion engine.

4 Claims, 1 Drawing Figure

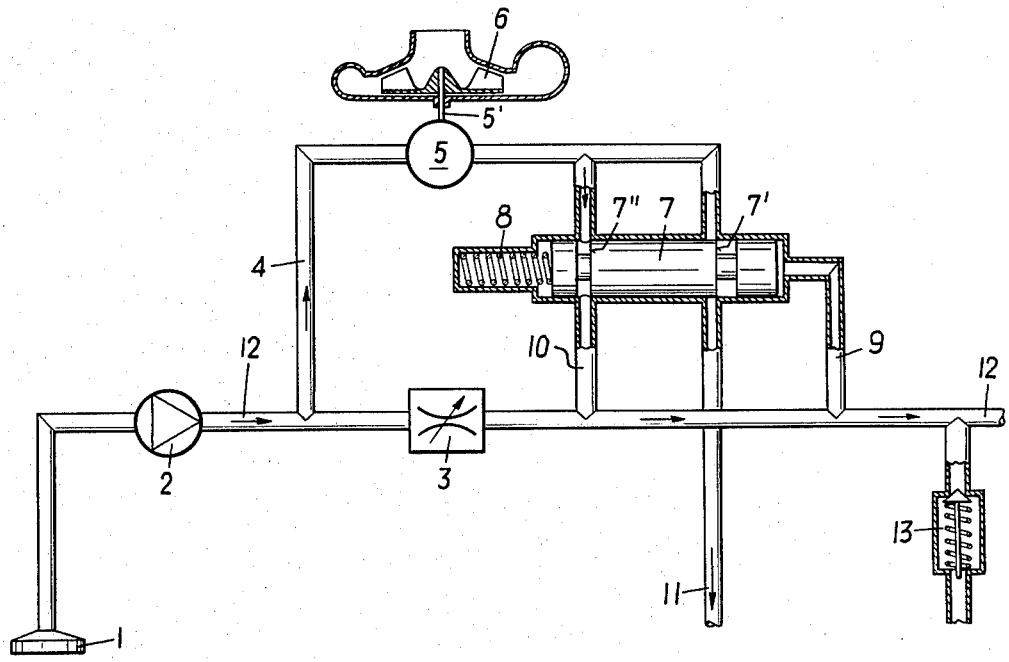
6
5'
5
8
7"
7
7'
4
12
10
9
12
2
3
13
11
1

WATER-COOLED INTERNAL COMBUSTION ENGINE USING HYDRAULIC-OIL LUBRICATION AND COOLING-WATER PUMP

BACKGROUND OF THE INVENTION

This invention relates to a water-cooled internal combustion engine using hydraulic oil lubrication and a cooling water pump driven as a function of the load of the internal combustion pump.

In this type of water-cooled internal combustion engine the rotational speed of the cooling-water pump is dependent upon the engine speed through a mechanical drive using V-belts, toothed gears or toothed belts. Since the water pump for the cooling water is designed for maximum load of the internal combustion engine, for partial loads, the pump delivers quantities of cooling water which are not needed for cooling the internal combustion engine.

The quantity delivered by the oil pump of an internal combustion engine must be such that when the rotational speed during operation of the internal combustion engine is at its lowest, sufficient oil will be delivered for lubrication. As is known, at higher rotational speeds the excess oil is, therefore part of the energy which must be produced in the oil pump is wasted.

SUMMARY OF THE INVENTION

It is an object of the invention to design the internal combustion engine referred to above such that energy losses in the oil pump are avoided and cooling water is delivered only in the exact quantity required for consumption.

According to the invention, this problem is solved by means of an internal combustion engine in which a hydraulic motor is provided for the drive of the cooling-water pump and which can be switched into the hydraulic-oil circuit of the internal combustion engine by means of a control element. Thus, the excess oil arising at high rotational speeds of the internal combustion engine is utilized to drive a hydraulic motor for the water pump. Because of the utilization of the oil which would otherwise be lost owing to discharge, and the possibility of controlling the rotational speed of the water pump by the hydraulic motor as a function of the temperature of the cooling water by means of the aforementioned control element, the friction horsepower of the internal combustion engine can be reduced in relation to conventional designs.

For low rotational speeds and with the internal combustion engine carrying a load, that is to say, in a zone of action where no oil is discharged and yet a flow of cooling water is required, the control described above results in the utilization of all or part of the oil needed for the lubrication to operate the hydraulic motor of the water pump.

If the water pump is provided with a hydraulic drive, the control of the cooling-water temperature through thermostats, which is needed in conventional cooling systems, can be dispensed with. The temperature level of the cooling water is controlled with its rate of flow. The control element may be a valve in the system for the drive of the hydraulic motor of the cooling-water pump which is responsive to the temperature of the cooling water.

The drive of the cooling-water pump with a hydraulic motor allows an optimal (i.e., unaffected by a conventional drive) arrangement of the water pump on the internal combustion engine. Thus, for example, the water pump may be placed with its shaft transversely of the crankshaft axis of the internal combustion engine so as to reduce the width thereof.

In another embodiment of the invention, a control device may conveniently be placed in the oil outlet of the hydraulic motor and operating in dependence upon the lubricating-oil pressure in the piping of the hydraulic-oil circuit, the control device discharging the oil coming from the hydraulic motor into the oil pan when the lubricating-oil pressure necessary for a dependable lubrication is exceeded, and introducing the oil coming from the hydraulic motor into the lubricating oil circuit when the pressure of the lubricating oil falls below the prescribed value.

According to a practical embodiment of the invention, there is provided in the piping of the hydraulic-oil circuit of the oil pump a control element (e.g., a valve) which responds to the temperature of the cooling water, and that between the oil pump and the control element a branch pipe leads to the hydraulic motor, which can be connected to the piping of the hydraulic-oil circuit via a conduit as well as, via a second conduit, to the oil pan.

Finally, in another development of the invention, the control device may comprise a control plunger which operates in a cylinder against the tension of a spring and which as two control edges, the cylinder being connected at a front end thereof via a conduit to the piping of the hydraulic-oil circuit and—depending upon the pressure in the hydraulic-oil circuit—the control edges open or close either one of the conduit to the hydraulic-oil circuit or the conduit to the oil pan.

BRIEF DESCRIPTION OF THE DRAWINGS

The invention will now be described with reference to a schematic representation of the oil conduits and control valves for operating the hydraulic motor, shown in the single FIGURE of drawing.

The oil is sucked up from oil pump 2 through suction filter 1. Then, when control element 3 (in the form of a valve) is opened, it flows therethrough to a conduit 12 leading to the main oil conduit and further to the bearing points in the internal combustion engine, not shown herein. When control element 3 is closed, the oil flows, as indicated by the arrows in pipelines 12, 4 and 10, through branch pipe 4 to a hydraulic motor 5 driving the cooling-water pump 6 via a shaft 5'. Depending on the position of a control device in the form of a spring biased plunger 7, the oil, after leaving hydraulic motor 5, can return through conduit 10 to conduit 12 and can further be used for lubrication, or it returns without resistance through conduit 11 to the oil pan (not shown ) of the engine. The position of control plunger 7, which is connected to conduit 12 via conduit 9, depends upon the oil pressure in conduit 12. When the oil pressure in conduit 12 exceeds a value which is necessary for the lubrication, control plunger 7 moves to the left through admission conduit 9 against the action of spring 8, as shown in the drawing. In the process, connecting pipe 10 between hydraulic motor 5 and conduit 12 is closed by control edge 7'' of control plunger 7 and at the same time conduit 11 from hydraulic motor 5 to the oil pan is opened.

When the oil pressure in conduit 12 falls below the prescribed value, spring 8 presses control plunger 7 to the right, as shown in the drawing, so that conduit 11 leading to the oil pan is closed by control edge 7' and connecting conduit 10 to conduit 12 is opened.

In this way, the oil leaving hydraulic motor 5 again flows into conduit 12, so that a sufficient amount of oil is available for the lubrication.

A safety valve 13 may also be provided in order to avoid any excess oil pressure that may occur in conduit 12. If an oil cooler and an oil filter are provided, the safety valve is positioned downstream thereof. However, it is more effective to mount the safety valve upstream in the main distribution duct of the lubricating oil in the internal combustion engine.

Thus, the rotational speed of hydraulic motor 5 or of water pump 6 can be controlled with valve 3 as a function of the temperature of the cooling water and by means of the lubricating oil.

Obviously, many modifications and variations of the present invention are made possible in the light of the above teachings. It is therefore to be understood that within the scope of the appended claims the invention may be practiced otherwise than as specifically described.

What is claimed is:

1. A water-cooled internal combustion engine including piping defining an hydraulic oil circuit having an oil pump and using hydraulic oil lubrication and a cooling-water pump driven as a function of the operating condition of the internal combustion engine, characterized in that a hydraulic motor is provided in the circuit for the drive of the cooling-water pump which, by means of a control element, can be switched into the hydraulic oil circuit of the internal combustion engine, and a control device operating as a function of the lubricating oil pressure in the piping of the hydraulic oil circuit, is located at the oil outlet side of the hydraulic motor for discharging the oil coming from the hydraulic motor into the oil pan when the lubricating-oil pressure necessary for a dependable lubrication is exceeded, and for introducing the oil ciming from the hydraulic motor into the lubricating oil circuit when the lubricating-oil pressure falls below a prescribed value.

2. The internal combustion engine according to claim 1, wherein the control element is of a type which is controlled as a function of the temperature of the cooling water and throttles the oil supply to the hydraulic motor when the temperature of the colling water falls below the operating temperature.

3. The internal combustion engine according to claim 2 wherein the control element in the form of a valve (3) is provided in the piping of the hydraulic circuit of the oil pump, a branch pipe being located between the oil pump and the control element and leading to the hydraulic motor, a first conduit connecting the hydraulic motor to the piping of the hydraulic oil circuit, and a second conduit connecting the hydraulic motor to an oil pan of the engine.

4. The internal combustion engine according to claim 3, wherein the control device comprises a control plunger having two control edges and operating in a cylinder against the tension of a spring, the cylinder communicating with said first and second conduits, the control edges opening one and closing the other of said first and second conduits upon the shifting of the plunger within the cylinder, a third conduit connecting a front end of the cylinder to the piping of the hydraulic oil circuit, and the shifting of the plunger being dependent upon the pressure in the hydraulic-oil circuit, the pressure in the first or the pressure in the second conduit.

* * * * *